US005223157A

United States Patent [19]

Brückner et al.

[11] Patent Number: 5,223,157

[45] Date of Patent: Jun. 29, 1993

[54] REGULATING DEVICE FOR REGULATING THE FLOW OF MOLTEN METAL FROM A METALLURGICAL VESSEL

[75] Inventors: Raimund Brückner, Engenhahn; José Gimpera, Wiesbaden; Rolf Waltenspühl, Hunenberg, all of Fed. Rep. of Germany

[73] Assignee: Didier-Werke AG, Wiesbaden, Fed. Rep. of Germany

[21] Appl. No.: 507,562

[22] Filed: Apr. 11, 1990

[30] Foreign Application Priority Data

Apr. 11, 1989 [DE] Fed. Rep. of Germany ..... 3911736

[51] Int. Cl.[5] ..... B22D 41/50

[52] U.S. Cl. ..... 222/599; 222/597; 222/594

[58] Field of Search ..... 222/597, 598, 599, 594, 222/606, 607; 266/236

[56] References Cited

U.S. PATENT DOCUMENTS

| | | | |
|---|---|---|---|
| 3,651,998 | 3/1972 | Rocher | 222/598 |
| 4,368,834 | 1/1983 | Daussan et al. | 222/597 |
| 4,747,580 | 5/1988 | Tinnes et al. | 222/598 |
| 4,905,876 | 3/1990 | Gimpera | 222/598 |

FOREIGN PATENT DOCUMENTS

| | | |
|---|---|---|
| 3540202 | 11/1986 | Fed. Rep. of Germany . |
| 3731600 | 4/1989 | Fed. Rep. of Germany . |

*Primary Examiner*—Scott Kastler
*Attorney, Agent, or Firm*—Wenderoth, Lind & Ponack

[57] ABSTRACT

A regulating device for regulating the flow of molten metal from metallurgical vessel includes an inner tubular part which is fixed to the metallurgical vessel and defines at least one through-hole, and a movable outer tubular part rotatably and/or slidably mounted to the metallurgical vessel and extending around the tubular inner part. The tubular outer part terminates at a bottom edge constituted by a contiguous land extending around the tubular inner part. The tubular outer part can be slid and/or rotated between open and closed positions at which the through-hole of the tubular inner part is opened and closed, respectively. To prevent plugs of molten metal from hardening in the at least one through-hole of the tubular inner part, the bottom edge of the tubular outer part is designed so that a portion of the land thereof passes across the at least one through-hole when the tubular outer part is moved between the open and closed position. More specifically, at the closed position, a portion of the land constituting the bottom edge is located to one side of the through-hole with respect to the longitudinal axis of the tubular inner part while, at the open position a portion of the land constituting the bottom edge is located to the other side of the through-hole with respect to the longitudinal axis of the tubular inner part.

24 Claims, 3 Drawing Sheets

16
W1
W2
2
19
15,21
18
14
20
13
3
17
1
22
W2

12
10
11
9
8
7
20
4
5
1
14
2
6
3
13
I

REGULATING DEVICE FOR REGULATING THE FLOW OF MOLTEN METAL FROM A METALLURGICAL VESSEL

BACKGROUND OF THE INVENTION

The present invention relates to a regulating device for regulating the flow of molten metal from a metallurgical vessel wherein the device comprises a fixed tubular inner part defining at least one through-hole, and a movable tubular outer part extending around the tubular inner part and rotatable and/or slidable between a closed position, at which the tubular outer part covers the at least one through-hole to prevent molten metal from flowing from a metallurgical vessel through the at least one through-hole, and an open position at which molten metal may flow through the at least one through-hole and out of the metallurgical vessel.

Such regulating devices include the one disclosed in DE-PS 35 40 202, and are characterized in that the tubular outer part also defines a through-hole which is aligned exactly and substantially with the through-hole hole of the tubular inner part when at the open position, and is substantially out of alignment with the through-hole of the tubular inner part when at the closed position.

When the vessel is filled with molten metal, the tubular outer part is disposed at the closed position. The temperature of the tubular inner and outer parts, even if such parts are pre-heated, can initially be lower than the temperature of the molten metal in the metallurgical vessel. Test have shown that the molten metal can harden in the through-holes of the tubular outer part so as to form plugs, which plugs jam the through-holes of the tubular outer part tightly. These plugs are, on the one hand, enclosed by the edge of the comparatively cold and slightly thermally conductive tubular outer part which defines the through-hole, and, on the other hand are bordered by the tubular inner part which is also slightly thermally conductive and comparatively cold. The plugs are exposed to the hot molten metal only at one side (the outer side) thereof. Apparently, such a nearly entire enclosure of the plugs contributes to the fact that these plugs dissolve only after a long period of time, which fact has been confirmed by testing. As long as the plugs exist, it is not possible to discharge molten metal from the metallurgical vessel. The plugs in the through-holes of the tubular outer part do not dissolve, even when the tubular outer part is moved, since the plugs are encircled by that portion of the tubular outer part which defines the through-holes. In other words, the plugs move with the movement of the tubular outer part.

A similar regulating device is disclosed in DE-OS 37 31 600. The regulating device disclosed in this reference comprises a tubular outer part which is fixed to the metallurgical vessel, and a tubular inner part which can be moved relative to the outer part. Plugs can be formed in the above-described manner in the through-holes of the tubular outer part. Thus, the prior art disclosed in DE-OS 3 31 600 is subjected to the problem discussed above.

SUMMARY OF THE INVENTION

The object of the present invention is to provided a tubular outer part of a regulating device for regulating the flow of molten metal from a metallurgical vessel, which tubular outer part is not subject to having molten metal hardening into plugs therein.

To achieve the above object, the regulating device of the present invention comprises a tubular outer part terminating at a bottom edge constituted by a contiguous land which extends around the tubular inner part, and the tubular outer part is movable between a closed position, at which a portion of the land constituting the bottom edge is located adjacent the at least one through-hole to one side thereof with respect to the longitudinal axis of the tubular inner valve part, and an open position at which a portion of the land constituting the bottom edge is located adjacent the at least one through-hole to the other side thereof with respect to the longitudinal axis of the tubular inner part.

Thus, the tubular outer part of the present invention does not employ the through-holes of the prior art. Only the terminal bottom edge of the outer tubular part bring about the opening and closing of the through-hole(s) of the tubular inner part as the tubular outer part is rotated or slid longitudinally relative to the tubular inner part.

Because the tubular outer part does not have through-holes, the molten metal cannot harden in the tubular outer part when molten metal is poured into the metallurgical vessel. In the region at the terminal bottom edge of the tubular outer part, the molten metal does not harden since the molten metal at such location is mostly surrounded with the bulk of the molten metal disposed in the metallurgical vessel. Specifically, plugs of molten metal cannot jam in the tubular outer part since the bottom edge of the tubular outer part only borders one side of the molten metal and dose not envelop the molten metal as does the portion of the tubular outer part defining the through-holes in the prior art. In addition, the movement of the tubular outer part prevents an incrustation of hardened molten metal.

In one embodiment according to the invention, the bottom edge of the tubular outer part lies substantially in a plane extending radially of the tubular outer part, and the tubular outer part is slidable relative to the tubular inner part in a longitudinal direction whereby the bottom edge passes across the through-hole of the tubular inner part as the tubular outer part is slid between open and closed positions. According to this embodiment, the tubular inner part defines a plurality of through-holes distributed about the periphery of the tubular inner part, which through-holes are opened and closed/throttled by the sliding of the tubular outer part longitudinally of the tubular inner part. The through-holes can be disposed in different radial planes whereby the through-holes are opened or closed one after the other as the tubular outer part is slid longitudinally of the tubular inner part.

In another embodiment according to the invention, the tubular outer part is rotatable relative to the tubular inner part, about the longitudinal axis thereof, between open and closed positions. At the closed position, a first portion of the land is located adjacent the through-hole of the tubular inner part and to one side thereof with respect to the longitudinal axis of the tubular inner part. On the other hand, when the tubular outer part is rotated to the open position, a second portion of the land is located adjacent the through-hole and to the other side thereof with respect to the longitudinal axis of the tubular inner part. In this embodiment, it is preferred that the longitudinal axes of the tubular inner and outer parts be coincident, and that the tubular outer part need only be rotated about the common longitudinal axis in order to open and closed the through-hole(s) of the tubular inner part. Such features of the present invention contribute to the fact that the rotational movement of the tubular outer part is easy, and that the inner peripheral surface of the tubular outer part and the outer peripheral surface of the tubular inner part form guide surfaces for one another, which guide surfaces can provide a leak-proof seal against the passage of molten metal therebetween.

According to a further feature of the present invention, a third portion of the land constituting the bottom edge of the tubular outer part can be designed so as to throttle the through-hole a predetermined amount as a function of the rotary position of the tubular outer part relative to the tubular inner part.

Further objects, features and advantages of the present invention will become apparent to those of ordinary skill in the art from reviewing the detailed description of the preferred embodiments of the present invention below in conjunction with the accompanying drawings.

DETAILED DESCRIPTION OF THE PREFERRED EMBODIMENTS

Figure 2:
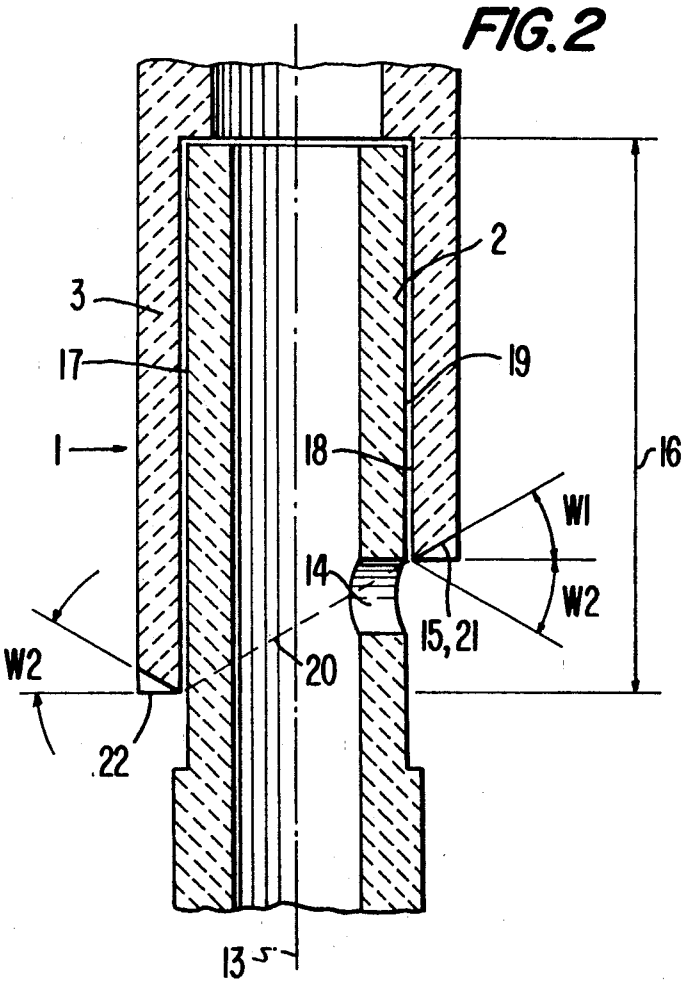
FIG. 2 is a detailed view showing a portion of the regulating device of FIG. 1 on an enlarged scale, according to the present invention.

The regulating device 1 of the present invention comprises a tubular outer part 3 and a tubular inner part 2, each of which parts comprises a ceramic, refractory material. The tubular inner part 2 is secured to a tundish 5 in the refractory lining 4 thereof by mortar in an air-tight and liquid-tight manner. The so-fixed tubular inner part 2 is open to an overflow nozzle 6 through which molten metal is discharged from the tundish 5.

The movable outer tubular part 3 is attached, in a swivel-proof manner, by bolts 7 to a holder 8. The holder 8, in turn, is connected to a drive arm 10 via a Cardan joint 9. The drive arm 10 is supported on a pedestal 11 of the tundish 5 and has, on the outer end thereof, a lever 12 which is manually operable to transmit a drive force to the movable tubular outer part 3 of the regulating device 1 via the drive arm 10, the Cardan joint 9 and the holder 8 which constitute an actuating means for moving the tubular outer part 3 in the device. Thus, the movable tubular outer part 3 can be rotated relative to the fixed tubular inner part 2 about a common longitudinal axis 13 in either of opposite rotational directions. In addition, as in the embodiment of FIG. 3, the actuating means for moving the tubular outer part 3 relative to the fixed tubular inner part 2 can slide the movable tubular outer part 3 relative to the fixed tubular inner part 2 along the common longitudinal axis 13. Alternatively, as in the embodiment of FIG. 6, the tubular outer part 3 can only be slid longitudinally in a direction along the common axis 13 relative to the fixed tubular inner part 2. The tubular inner part 2 defines at least one through-hole 14 extending therethrough and open to the interior thereof forming the discharge channel of the regulating device. The tubular outer part terminates, opposite to holder 8, at a bottom edge 15 thereof. It is to be noted that the tubular outer part 3 is not provided with through-holes similar to the through-holes 14 of the tubular inner part 2.

The bottom edge 15 of the tubular outer part 3 is constituted by a contiguous land extending around the tubular inner part 2 between inner and outer peripheral surfaces of the tubular outer part. Within an axial dimension 16, the inner peripheral surface of the tubular outer part 3 and the outer peripheral surface of the tubular inner part 2 form sealing surfaces 17 and 18, respectively, which are sealingly engaged in a liquid-tight manner. An annular gap 19 is defined between the inner and outer peripheral surfaces 17, 18.

In the embodiment of FIG. 2, the tubular inner part 2 defines only one through-hole 14. The land constituting the bottom edge 15 has a first portion 22, a second portion 21, and one or two third portions 20 one of which is shown by a broken line. The third portion 20 of the land, as extending between the first 22 and second 21 portions of the land, is inclined relative to the longitudinal axis 13 of the tubular outer part 3. Also, as shown in FIG. 2, all of the portions of the land constituting the bottom edge 15, as extending between the inner and outer peripheral surfaces of the tubular outer part 3, are inclined relative to the longitudinal axis 13.

Figure 1:
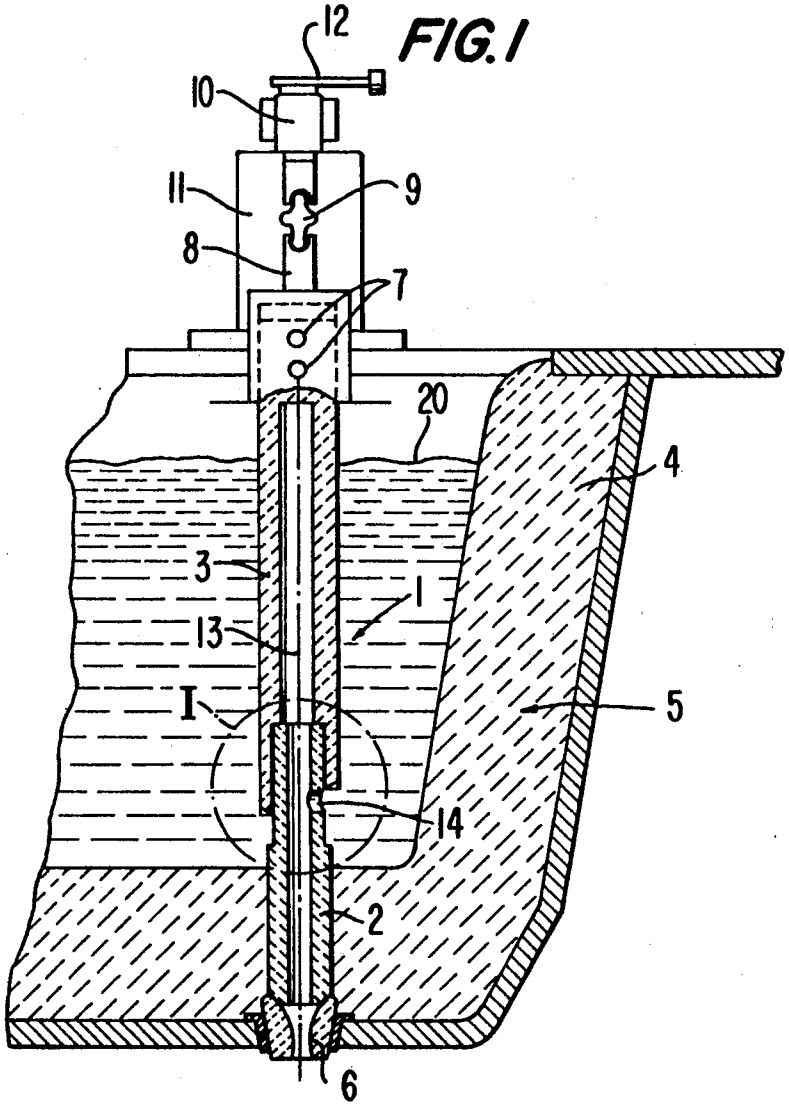
FIG. 1 is a partial sectional view of a regulating device of a metallurgical vessel for regulating the flow of molten metal from the vessel, the vessel being a tundish and only being partially illustrated, according to the present invention.

In FIG. 2, the tubular outer part 3 is shown in its open position. The second portion of the land is located above the through-hole 14, i.e. adjacent the through-hole 14 and to one side thereof with respect to the longitudinal axis 13, so that the through-hole 14 is exposed to the exterior of the tubular outer part 3, i.e. the interior of the tundish 5 as shown in FIG. 1.

If the tubular outer part 3 is rotated about the longitudinal axis 13 from the open position, the third portion 20 of the land travels across the through-hole 14. By such movement, depending upon the speed of rotation and the inclination of the third portion 20 of the land, the through-hole 14 is more or less eventually covered by the tubular outer part 3. The two third portions 20 of the land need not have the same linear inclination or even any linear inclination. The third portions 20 can be designed in such a manner that the through-hole 14 is covered by the tubular outer part 3 faster when the tubular outer part 3 is rotated a predetermined angle in one direction of rotation than when the tubular outer part 3 is rotated in the other direction of rotation by the same predetermined angle. The third portion of the land 20 can be inclined over its entirety so as to variably regulate the flow of molten metal into the through-hole 14 as the tubular outer part 3 is rotated between the open and closed positions. For example, if the third portion 20 has a linear inclination, a linearly proportional relation with respect to the flow of molten metal into the through-hole 14 exists between the rotation of the tubular outer part 3 and the free cross section of the through-hole 14.

When the tubular outer part 3 is rotated 180° from the position shown in FIG. 2, the tubular outer part 3 assumes a closed position at which the first portion 22 of the land is located directly below the through-hole 14, i.e. adjacent thereto and to the other side thereof with respect to the longitudinal axis 13. In such a position, the through-hole 14 is completely covered by the tubular outer part 3.

The tubular outer part 3 is placed in the closed position while the empty tundish 5 is filled with molten metal. The tubular inner part 2 and the tubular outer part 3 are colder than the molten metal that is introduced into the tundish 5. The bottom edge 15, constituted by the contiguous land having first 22, second 21 and third 20 portions, does not completely envelop any regions of molten metal, which could otherwise harden into plugs in the tubular outer part 3. Temporary regional incrustations dissolve subject to contact with the bulk of molten metal in the tundish, action which is enhanced by the movement of the third portion 20 of the land across the through-hole 14 as the tubular outer part 3 is rotated. Thus, the tubular outer part 3 can be brought immediately to its open position when a desired level of molten metal has been obtained in the tundish 5, wherein the molten metal is not prevented from flowing through the through-hole 14 by regions of metal hardened on the tubular outer part 3.

Referring again to the embodiment of FIG. 2, although the individual portions 20, 21, 22 of the land may extend radially relative to the longitudinal axis 13 between the inner and outer peripheral surfaces of the tubular outer part 3, it is also possible as shown in the figure to design the bottom edge 15 in such a manner that all of the portions 20, 21, 22 of the land are inclined at an angle W1 or W2 relative to the longitudinal axis 13, as extending between the inner and outer peripheral surfaces of the outer tubular part 3.

When the second 21 and third 20 portions of the land are disposed adjacent the through-hole 14, respectively, the inflow conditions of the molten metal into the through-hole 14 are influenced by the angles W1 or W2. By virtue of the angle W2 of the first portion 22 of the land, the molten metal does not flow therealong at a right angle or at an acute angle relative to the longitudinal axis 13 when the metallurgical vessel is filled, a feature that further prevents the molten metal from hardening on the tubular outer part 3.

Figure 4:
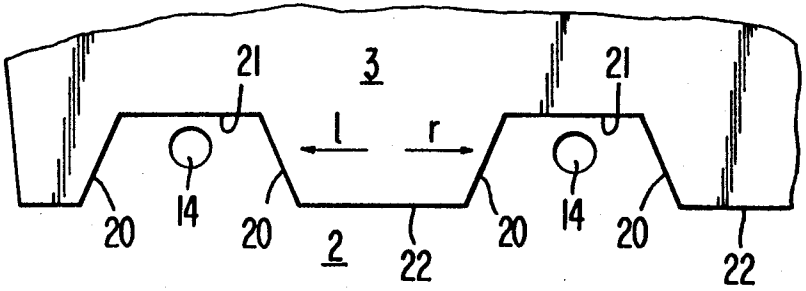
FIG. 4 is a schematic diagram illustrating one form of the bottom edge of the tubular outer part in the regulating device shown in FIG. 3, according to the present invention.
Figure 5:
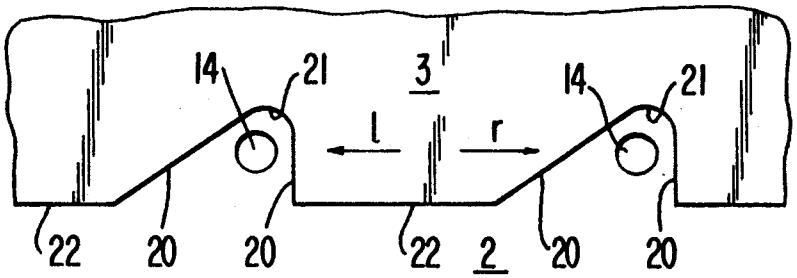
FIG. 5 is a schematic diagram of another form of the bottom edge of the tubular outer part.
Figure 3:
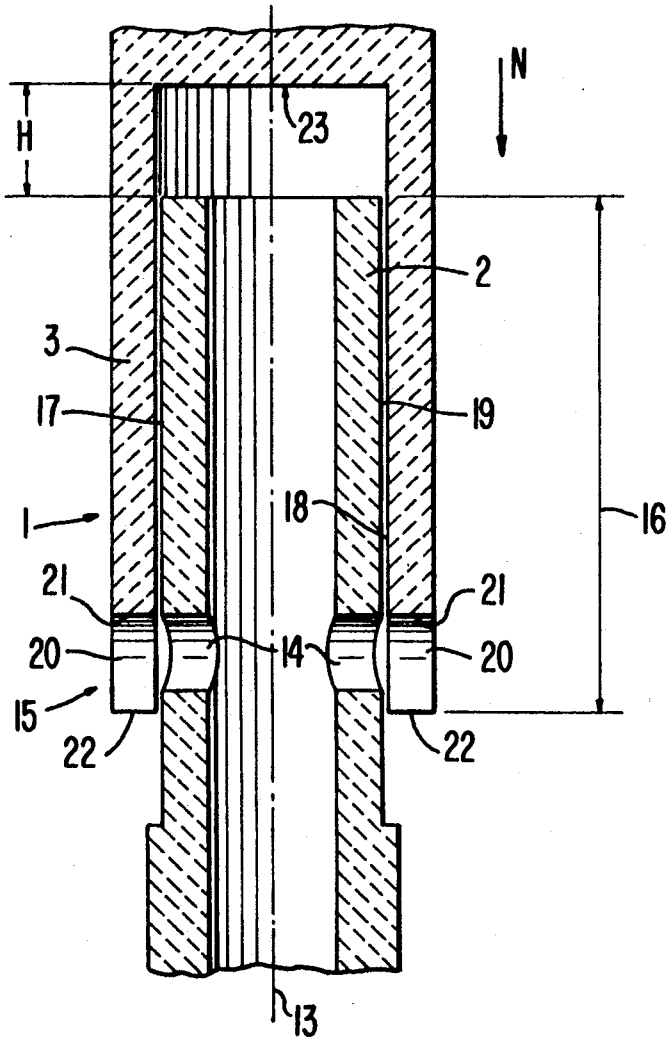
FIG. 3 is a view similar to that of FIG. 2 but showing another embodiment of a regulating device according to the present invention.

In the embodiment of FIG. 3, the tubular inner part 2 has two diametrically opposed through-holes 14. Correspondingly, the first 22, second 21 and third 20 portions of the land are provided in pairs along the bottom edge 15 of the tubular outer part 3. In FIGS. 4 and 5, various configurations of the bottom edge 15 are shown, and in FIGS. 3–5, the open position of the tubular outer part 3 is shown. In such an open position, the two second portions 21 of the land lie adjacent the through-holes 14, respectively, and to one side thereof with respect to the longitudinal axis 13, i.e. directly above the through-holes 14.

In the embodiment of FIG. 4, the third portions 20 of the land directly adjoin both a respective first 22 and a second 21 portion of the land with the same obtuse angle being defined between the third portions 20 of the land and each of the first 22 and/or second 21 portions of the land directly adjoined thereto. Owing to such, when the tubular outer part 3 is rotated, the two through-holes 14 are closed at the same speed independent of the direction of rotation (r or l) about the tubular inner part 2. If the tubular outer part 3 is rotated 90° from the open position, both through-holes 14 are closed, wherein two first portions 22 of the land are located directly below the through-holes 14, respectively. The closing of one of the through-holes 14 prior to the closing of the other of the through-holes 14 can be achieved by spacing the through-holes 14 other than at 180° from one another or by spacing the two second portions 21 of the land other than at 180° from one another.

Further, it should be noted that a design of the two portions 20 of the land associated with each through-hole 14 as symmetrical with respect to both directions of rotation l, r has the advantage that if, for example, the portions 20 which lie to the left of the through-holes 14, respectively, at the open position become worn during a long operation in which the outer tubular part 3 is rotated in one direction of rotation, the tubular outer part 3 can then be rotated in the other direction of rotation so that the portions 20 of the land which lie to the right of the through-holes 14, respectively, at the open position can be used to regulate the flow of molten metal without changing the characteristics of the inflow of molten metal to the through-holes 14.

In the embodiment of FIG. 5, the two third portions 20 of the land associated with each of the through-holes 14 define different angles with the first portions 22 of the land directly adjoined thereto. Owing to such a feature, when the tubular outer part 3 is rotated in the direction of arrow l, the through-holes 14 are closed faster than when the tubular outer part 3 is rotated in the direction of arrow r.

Again referring to the embodiment of FIG. 3, the outer tubular part 3 can also be slid over a distance H along the longitudinal axis 13 relative to the tubular inner part 2. The distance H is sufficient to allow the tubular outer part 3 to be slidable relative to the tubular inner part 2 between a first position at which the second portion 21 of the land is located to one side of the through-hole 14 with respect to the longitudinal axis 13 and a second position at which the second portion 21 of the land is located to the other side of the through-hole 14 with respect to the longitudinal axis 13. Such a feature of the present invention is advantageous in that when a failure occurs in which the tubular outer part 3 can no longer be rotated relative to the tubular inner part 2, the tubular outer part 3 can be slid from the above-mentioned first position shown in FIG. 3 constituting the open position, in the direction of arrow N until an inner radial surface 23 abuts the top of the tubular inner part 2 at which point the tubular outer part 3 assumes the above-mentioned second position which closes the through-hole(s) 14. The inner radial surface 23 of the tubular outer part 3 thus closes the open top of the tubular inner part 2.

Figure 6:
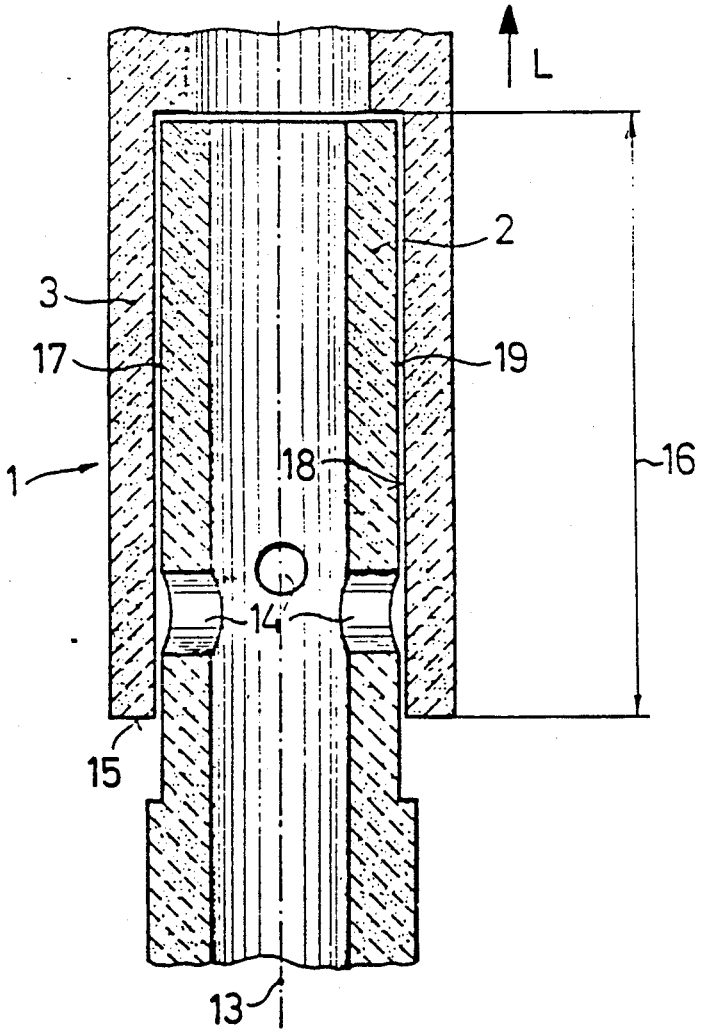
FIG. 6 is a view similar to that of FIG. 2 but showing still another embodiment of a regulating device according to the present invention.

In the embodiment of FIG. 6, the tubular outer part 3 is shown in the closed position. In this embodiment, as discussed previously, the tubular outer part 3 is only slidable along the longitudinal axis 13 relative to the tubular inner part 2. If the tubular outer part 3 is moved from the closed position in the direction of arrow L, the contiguous land constituting the bottom edge 15 passes across the through-holes 14. The entirety of the bottom edge 15 in this embodiment lies substantially in a plane extending radially of the tubular outer part 3. In the open position of the tubular outer part 3, all of the through-holes 14 are exposed whereby molten metal is free to enter the tubular inner part 2.

The present invention has been described above with respect to preferred embodiments thereof. Various other embodiments, changes and modifications in the present invention will become apparent to those of ordinary skill in the art. For instance, various features of respective ones of the embodiments may be applied to the other embodiments. All such various embodiments, changes and modifications are seen to be within the true spirit and scope of the present invention as defined by the appended claims.

What is claimed is:

1. A regulating device of a metallurgical vessel for regulating the flow of molten metal from the vessel, said device comprising:

a tubular inner part fixed to the metallurgical vessel, said tubular inner part defining at least one through-hole extending therethrough and open to the interior thereof;

a tubular outer part rotatably or slidably or both rotatably and slidably mounted to the metallurgical vessel, and extending around said tubular inner part, so as to be rotatably or slidable or both rotatable and slidable relative to said inner part, said tubular outer part terminating at a bottom edge constituted by a contiguous land extending between inner and outer peripheral surfaces of said outer part and disposed around said tubular inner part within the metallurgical vessel; and actuating means connected to said tubular outer part for moving said tubular outer part between a closed position at which said tubular outer part covers said at least one through-hole and a portion of the land constituting said bottom edge is located adjacent said at least one through-hole to one side thereof with respect to the longitudinal axis of said tubular inner part, and an open position at which a portion of the land constituting said bottom edge is located adjacent said at least one through-hole to the other side thereof with respect to the longitudinal axis of said tubular inner part and said at least one through-hole is open to the interior of the metallurgical vessel.

2. A regulating device of a metallurgical vessel as claimed in claim 1, wherein said tubular outer part is slidably mounted to the metallurgical vessel so as to be slidably relative to said inner part, and the entirety of said bottom edge lies substantially in a plane extending radially of said tubular outer part.

3. A regulating device of a metallurgical vessel as claimed in claim 1, wherein said tubular outer part is rotatably mounted to the metallurgical vessel so as to be rotatable relative to said inner part between said open and said closed positions, said portions of the land comprise respective first and second portions of the land spaced from one another along said bottom edge, and said contiguous land includes a third portion which travels across said at least one through-hole as said outer part is rotated relative to said inner part between said open and said closed positions.

4. A regulating device of a metallurgical vessel as claimed in claim 3, wherein the third portion of said land, as extending between the first and the second portions of the land, is inclined relative to the longitudinal axis of said outer part.

5. A regulating device of a metallurgical vessel as claimed in claim 3, wherein a plurality of said third portions of said land directly adjoin the first and the second portions of said land with obtuse angles being defined between the third portions of said land and the first and the second portions of said land directly adjoined thereto.

6. A regulating device of a metallurgical vessel as claimed in claim 5, wherein the obtuse angles defined between each of the third portions of said land and the third and/or second portions of the land adjoined thereto are equal.

7. A regulating device of a metallurgical vessel as claimed in claim 5, wherein the obtuse angles defined between each of the third portions of said land and the third and/or second portions of the land adjoined thereto are different.

8. A regulating device of a metallurgical vessel as claimed in claim 3, wherein the third portion of the land, as extending between the first and the second portions of the land, is inclined over its entirety relative to the longitudinal axis of said outer part so as to variably regulate the flow of molten metal into said at least one through-hole as said outer part is rotated between said open and said closed position.

9. A regulating device of a metallurgical vessel as claimed in claim 3, wherein said tubular outer part is also slidably mounted to the metallurgical vessel so as to be slidable relative to said tubular inner part between a first position at which the second portion of said land is located to one side of said at least on through-hole with respect to the longitudinal axis of said inner part and a second position at which the second portion of said land is located to the other side of said at least one through-hole with respect to the longitudinal axis of said inner part.

10. A regulating device of a metallurgical vessel as claimed in claim 1, wherein said contiguous land, as extending between the inner and the outer peripheral surfaces of said outer part, is inclined relative to a plane extending radially of said inner part.

11. A regulating device for use in a metallurgical vessel to regulate the flow of molten metal from the vessel, said device comprising:

a tubular inner part defining at least one through-hole extending therethrough and open to the interior thereof; and a tubular outer part extending around said tubular inner part and rotatable or slidable or both rotatable and slidable relative to said inner part, said tubular outer part terminating at a bottom edge constituted by a contiguous land extending between inner and outer peripheral surfaces of said outer part and disposed around said tubular inner part, said land including a first circumferential portion, a second circumferential portion, and a third circumferential portion disposed in the circumferential direction of the outer part between said first and said second circumferential portions, said third circumferential portion being inclined relative to said first and said second circumferential portions in a direction along the longitudinal axis of the outer part as viewed in said circumferential direction, said tubular outer part being slidable or rotatable or both slidable and rotatable relative to said tubular inner part between a closed position at which the outer part covers said inner part, and an open position at which said at least one through-hole is exposed to the exterior of said outer part, the third circumferential portion of said land moving across said at least one through-hole as said tubular outer part is moved between said open and said closed positions.

12. A regulating device for use in a metallurgical vessel as claimed in claim 11, wherein said tubular outer part is rotatable relative to said inner part, the third circumferential portion of said land travelling across said at least one through-hole as said outer part is rotated relative to said inner part between said open and said closed positions.

13. A regulating device for use in a metallurgical vessel as claimed in claim 12, wherein the third circumferential portion of said land, as extending between the first and second circumferential portions of the land, is inclined, relative to the longitudinal axis of said outer part.

14. A regulating device for use in a metallurgical vessel as claimed in claim 12, wherein a plurality of said third circumferential portions of said land directly adjoin the first and the second circumferential portions of said land with obtuse angles being defined between the third circumferential portions of said land and the first and the second circumferential portions of said land directly adjoined thereto.

15. A regulating device for use in a metallurgical vessel as claimed in claim 14, wherein the obtuse angles defined between each of the third circumferential portions of said land and at least one of the third and second circumferential portions of the land adjoined thereto are equal.

16. A regulating device for use in a metallurgical vessel as claimed in claim 14, wherein the obtuse angles defined between each of the third circumferential portions of said land and at least one of the third and second circumferential portions of the land adjoined thereto are different.

17. A regulating device for use in a metallurgical vessel as claimed in claim 2, wherein said tubular outer part is also slidable relative to said circumferential tubular inner part between a first position at which the second portion of said land is located to one side of said at least one through-hole with respect to the longitudinal axis of said inner part and a second circumferential position at which the second portion of said land is located to the other side of said at least one through-hole with respect to the longitudinal axis of said inner part.

18. A regulating device for use in a metallurgical vessel as claimed in claim 11, wherein said contiguous land, as extending between the inner and the outer peripheral surfaces of said outer part, is inclined relative to a plane extending radially of said inner part.

19. A tubular outer part for use in a regulating device of a metallurgical vessel for regulating the flow of molten metal from the vessel, said tubular outer part having a cylindrical body terminating at a bottom edge constituted by a contiguous land extending between inner and outer peripheral surfaces of said outer part, said land including a first circumferential portion, a second circumferential portion, and a third circumferential portion disposed in the circumferential direction of the outer part between said first and said second circumferential portions, said third circumferential portion being inclined relative to said first and said second circumferential portions in a direction along the longitudinal axis of the tubular outer part as viewed in said circumferential direction.

20. A tubular outer part as claimed in claim 19, wherein a plurality of said third circumferential portions of said land directly adjoin the first and the second circumferential portions of said land with obtuse angles being defined between the third circumferential portions of said land and the first and the second circumferential portions of said land directly adjoined thereto.

21. A tubular outer part as claimed in claim 20, wherein the obtuse angles defined between each of the third circumferential portions of said land and at least one of the third and second circumferential portions of the land adjoined thereto are equal.

22. A tubular outer part as claimed in claim 20, wherein the obtuse angles defined between each of the third circumferential portions of said land and at least one of the third and second circumferential portions of the land adjoined thereto are different.

23. A tubular outer part as claimed in claim 19, wherein said contiguous land, as extending between the inner and the outer peripheral surfaces of said outer part, is inclined relative to a plane extending radially of the longitudinal axis of said outer part.

24. A tubular outer part as claimed in claim 19, and comprising refractory ceramics.

* * * * *